US008096815B2

(12) United States Patent
Zhu

(10) Patent No.: US 8,096,815 B2
(45) Date of Patent: Jan. 17, 2012

(54) RELIABLE ELECTRICAL CONNECTION ELECTRICAL CONNECTOR ASSEMBLY

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 17 days.

(21) Appl. No.: 12/824,246

(22) Filed: Jun. 28, 2010

(65) Prior Publication Data

US 2011/0104914 A1 May 5, 2011

(30) Foreign Application Priority Data

Nov. 2, 2009 (CN) ..... 2009 2 0313864

(51) Int. Cl.
*H01R 12/00* (2006.01)

(52) U.S. Cl. ..... 439/83

(58) Field of Classification Search ..... 439/83, 439/79–80, 636–637, 540.1, 495–496, 567, 439/357

See application file for complete search history.

(56) References Cited

U.S. PATENT DOCUMENTS 5,472,354 A * 12/1995 Chen et al. ..... 439/357
6,648,682 B1 * 11/2003 Wu ..... 439/567
6,746,281 B1 * 6/2004 Zhang ..... 439/637
6,832,934 B1 12/2004 Zhang
7,484,994 B2 * 2/2009 Ko ..... 439/495
7,497,709 B1 * 3/2009 Zhang ..... 439/188
7,572,130 B1 * 8/2009 Zhang ..... 439/79
7,909,652 B2 * 3/2011 Yang et al. ..... 439/660

* cited by examiner

*Primary Examiner* — Jean F Duverne

(74) *Attorney, Agent, or Firm* — Wei Te Chung; Andrew C. Cheng; Ming Chieh Chang

(57) ABSTRACT

An electrical connector assembly has a printed circuit board having a row of first and second circuit traces and an electrical connector for mounting on the printed circuit board. The electrical connector includes an insulative housing having a longitudinal base and a pair of clip portions extending rearwardly from the base and a plurality of contacts respectively received in the insulative housing grouped into a set of first and second contacts. Each clip portion has a first partition, a second partition and a board-receiving groove therebetween. Each first contact has a first soldering point jointing on the first circuit trace and each second contact has a second soldering point jointing on the second circuit trace. At least one of the first contacts crossing over the second contact, and the first soldering point locates at the back of the second soldering point. When the printed circuit board is located in the entrance of the groove, the first soldering points are located between the first circuit traces and the second circuit traces so as to prevent the printed circuit board from abrading by the overlapped contacts.

15 Claims, 6 Drawing Sheets

RELIABLE ELECTRICAL CONNECTION ELECTRICAL CONNECTOR ASSEMBLY

BACKGROUND OF THE INVENTION

1. Field of the Invention

The present invention generally relates to an electrical connector assembly, and more particularly, to a novel structure of an electrical connector assembly having an electrical connector mounting horizontally on a printed circuit board.

2. Description of Related Art

An electrical plug connector as shown in U.S. Pat. No. 6,382,934, has a first and a second tongue plates and a third tongue plate unitarily connecting with the first and the second tongue plates. And a third set of contacts are assembled to a second surface of the third tongue while a first and a second sets of contact are assembled on a first surface of the first and second tongue plates opposite to the second surface. However, the total length of said three tongue plates is relatively longer, the ability of resisting an inadvertent bending force of the electrical plug connector is relatively weak. Thus, a micro and strengthened electrical plug connector is highly desired.

The micro electrical plug connector has two separated tongue plates side by side without the third tongue plates. A third set of contacts are assembled in the second surface of the first or the second tongue plates opposing to the first surface where the first and second sets contacts are mounted. At least one of the third set of contacts and the two sets of contacts are overlapped. However, the micro electrical plug connector is assembled horizontally on a printed circuit board, the overlapped contacts will frictionate the printed circuit board. Thus, an electrical plug connector mounting reliably on the printed circuit board is desired to overcome the disadvantages of the related art.

Hence, the present invention is directed to solving this problem in the related art.

SUMMARY OF THE INVENTION

An object of the invention is to provide an electrical connector assembly with a reliable electrical connection between an electrical connector and a printed circuit board.

In order to achieve the object set forth, an electrical connector assembly has a printed circuit board having a row of first and second circuit traces and an electrical connector for mounting on the printed circuit board. The electrical connector includes an insulative housing having a longitudinal base and a pair of clip portions extending rearwardly from the base and a plurality of contacts respectively received in the insulative housing grouped into a set of first and second contacts. Each clip portion has a first partition, a second partition and a board-receiving groove therebetween. Each first contact has a first soldering point jointing on the first circuit trace and each second contact has a second soldering point jointing on the second circuit trace. At least one of the first contacts crossing over the second contacts, and the first soldering point locates at the back of the second soldering point. When the printed circuit board is located in the entrance of the groove, the first soldering points are located between the first circuit traces and the second circuit traces so as to prevent the printed circuit board from abrading by the overlapped contacts.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
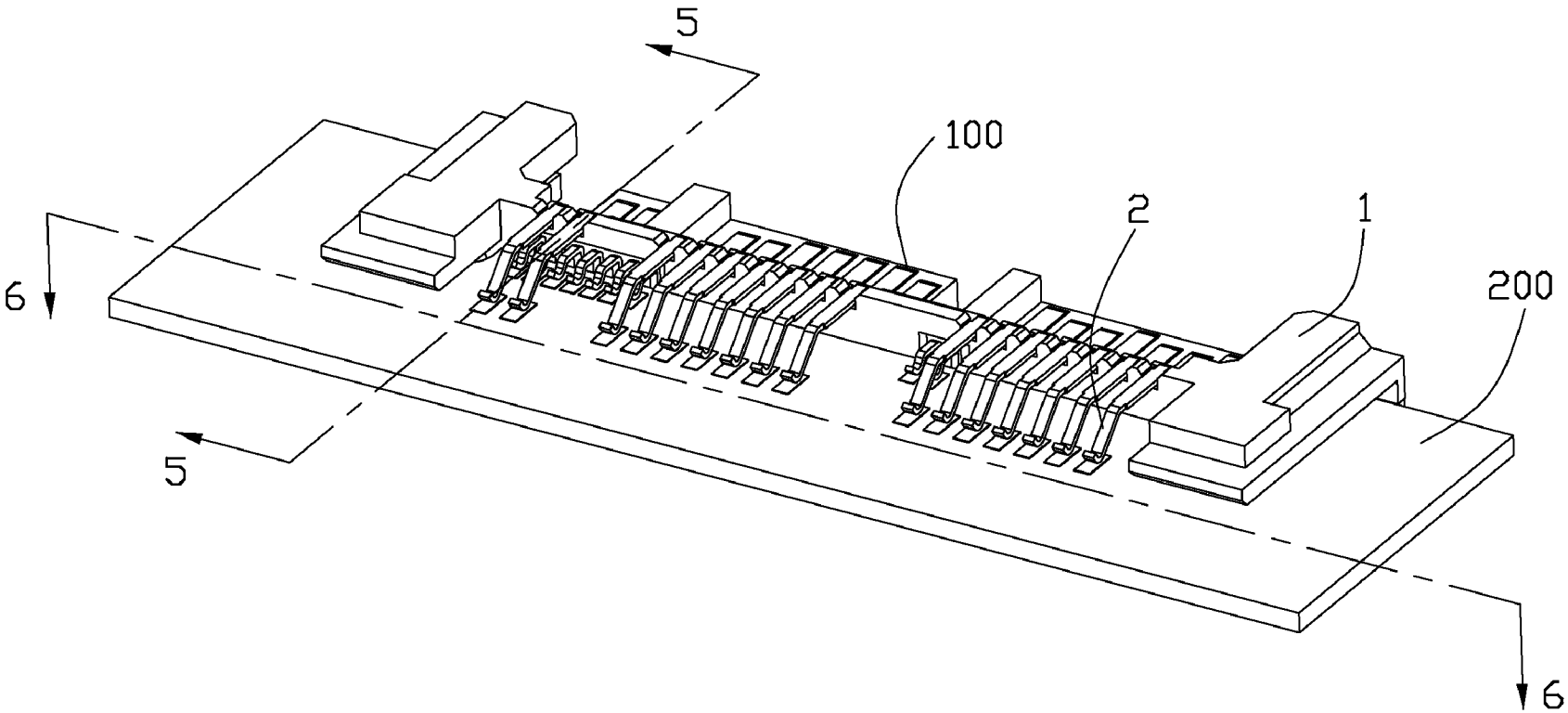
FIG. 1 is an assembled perspective view of an electrical connector assembly of an embodiment of the present invention.
Figure 2:
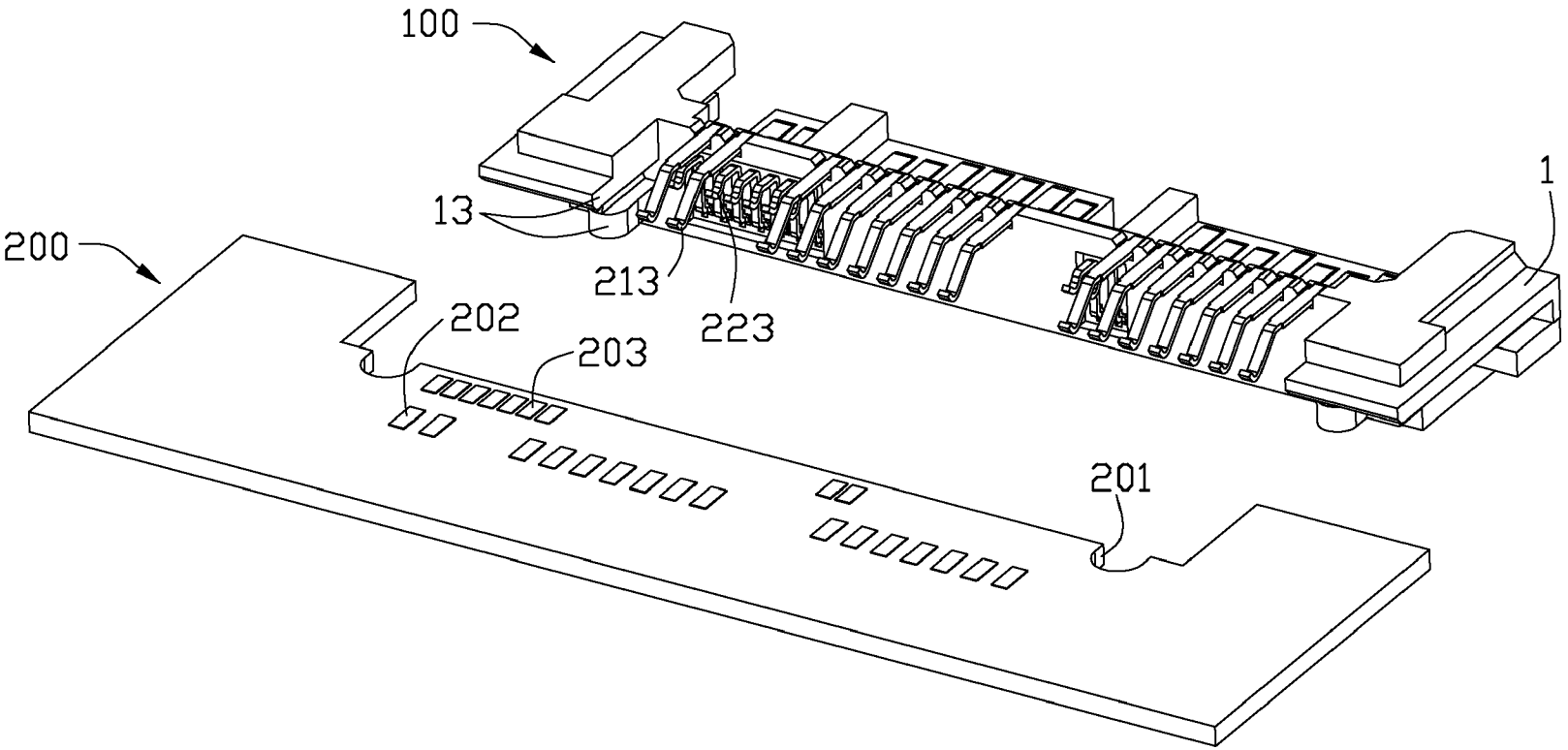
FIG. 2 is an exploded perspective view of the electrical connector assembly as shown in FIG. 1.

Referring to FIGS. 1 and 2, an electrical connector assembly of the present invention comprises a printed circuit board 200 and an electrical connector 100 mounting on the printed circuit board 200. The electrical connector 100 comprises an elongated, insulative housing 1 and a plurality of contacts 2 respectively received in the insulative housing 1 grouped into a set of first and second contacts 21, 22.

Figure 3:
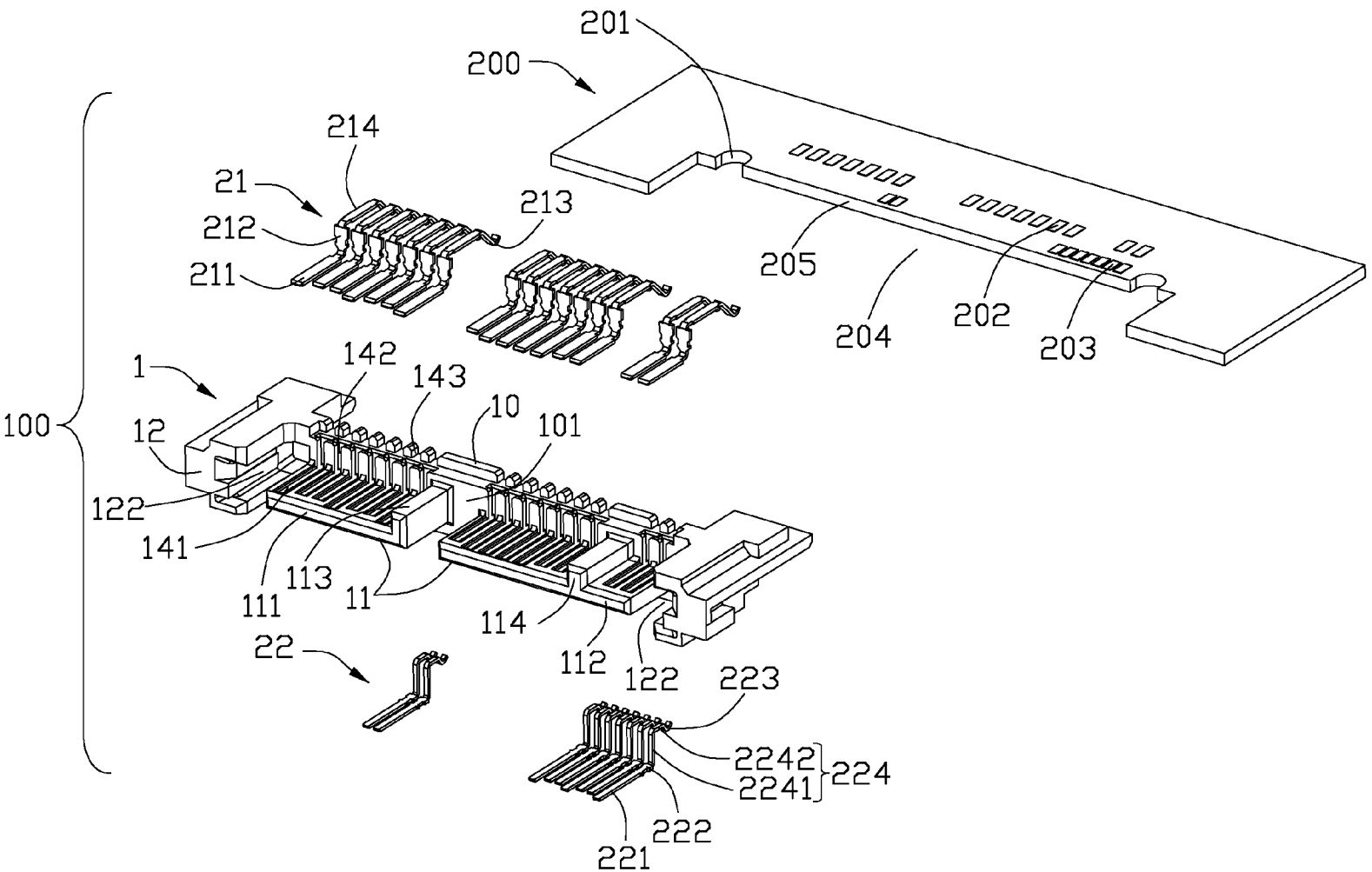
FIG. 3 is an exploded perspective view of the electrical connector assembly as shown in FIG. 1.
Figure 4:
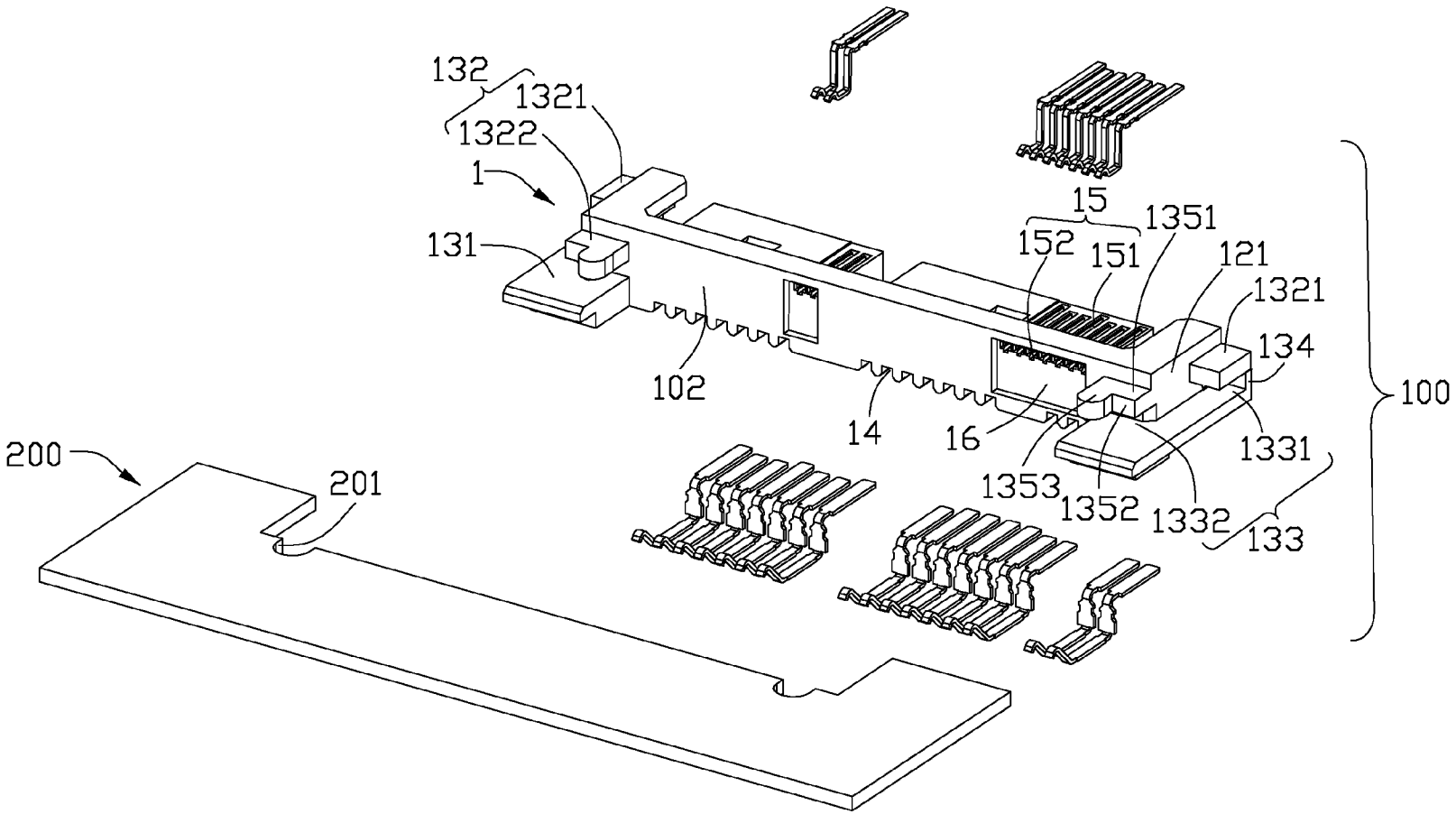
FIG. 4 is an exploded perspective view of the electrical connector assembly from another view.

Referring to FIGS. 3 and 4, the insulative housing 1 has a longitudinal base 10 defining a mating face 101 and a back face 102 opposite to the mating face 101, a tongue portion 11 extending forwardly from the base 10 side by side, a pair of end walls 12 extending forwardly from the base 10 at two ends of the tongue portion 11 and a pair of clip portions 13 defined at the two ends of the back face 102 of the base portion for retaining the printed circuit board 200. The pair of end walls 12 have opposite end faces 121. Each end wall 12 defines a inverted U-shaped guiding space 122 facing to the tongue portion 11 for guiding an insertion of a complementary connector.

The tongue portion 11 includes a first tongue portion 111 adjacent to one end wall 12 and a second tongue portion 112 adjacent to the other end wall 12 at the same surface. The first tongue portion 111 defining a first projection 113 extending therefrom is L-shape. The first projection 113 extends from one end and far from the end wall 12. The second tongue portion 112 defines a second projection 114. The distance from the second projection 114 to one end of the second tongue portion 112 is longer than the distance from the second projection 114 to the other end of the second tongue portion 112. The first tongue portion 111 and the second tongue portion 112 can be anti-mismating. The insulative housing 1 defines a plurality of first terminal passageways 14 extending downwardly at one side of the tongue portion 11 and a plurality of second terminal passageways 15 extending upwardly at the other side of the tongue portion 11. Each first terminal passageway has a first receiving slot 141 depressing from the tongue portion 11, a first retaining slot 142 extending rearwardly from the base 10 and a second receiving slot 143 extending downwardly from the base 10 (refer to FIG. 3). Each second terminal passageway 15 has a third receiving slot 151 extending upwardly from the tongue portion 11 and a second retaining slot 152 extending through the base 10. The base 10 defines two recesses 16 extending forwardly from the back face 102 corresponding to the first and second tongue portion 111,112. Each recess 16 communicates with all the second terminal passageways 15 defined the first or the second tongue portion 111,112 (refer to FIG. 4). One group of the second terminal passageways 15 defined at the first tongue portion 111 is under the first projection 113, the other group of the second terminal passageways 15 defined at the second tongue portion 112 is under the second projection 114 and the group of the first terminal passageways 14.

The first and second contacts 21, 22 are respectively secured in the first and second passageways 14, 15. Each first contact 21 has a first flat contact portion 211 received in the first receiving slot 141, a first retention portion 212 retained in the first retaining slot 142 and vertical to the tongue portion 11, a first soldering point 213 jointing elastically on the printed circuit board 200 and a first connecting portion 214 connecting with the first retention portion 211 and the first soldering point 213 and located in the second receiving slot 143. Each second contact 22 has a second contact portion 221 received in the third receiving slot 151, a second retention portion 222 retained in the second retaining slot 152 and parallel to the tongue portion 11, a second soldering point 223 jointing elastically on the printed circuit board 200 and a second connecting portion 224 connecting with the second retention portion 222 and the second soldering point 223. The first soldering point 213 and the second soldering point 223 at a same face of the printed circuit board 200. The second connecting portion 224 has a vertical portion 2241 received in the recess 16 and a horizontal portion 2242 connecting with the vertical portion 2241 and the second soldering point 223. The first contacts 21 are assembled in the first passageways from a top face of the housing 1 and the second contacts 222 are from the back face 102 of the housing 1. The second contacts 22 are shorter than the first contacts 21, particular the second soldering points 223 are in an inside of the first soldering points 213 (refer to FIG. 1).

Figure 5:
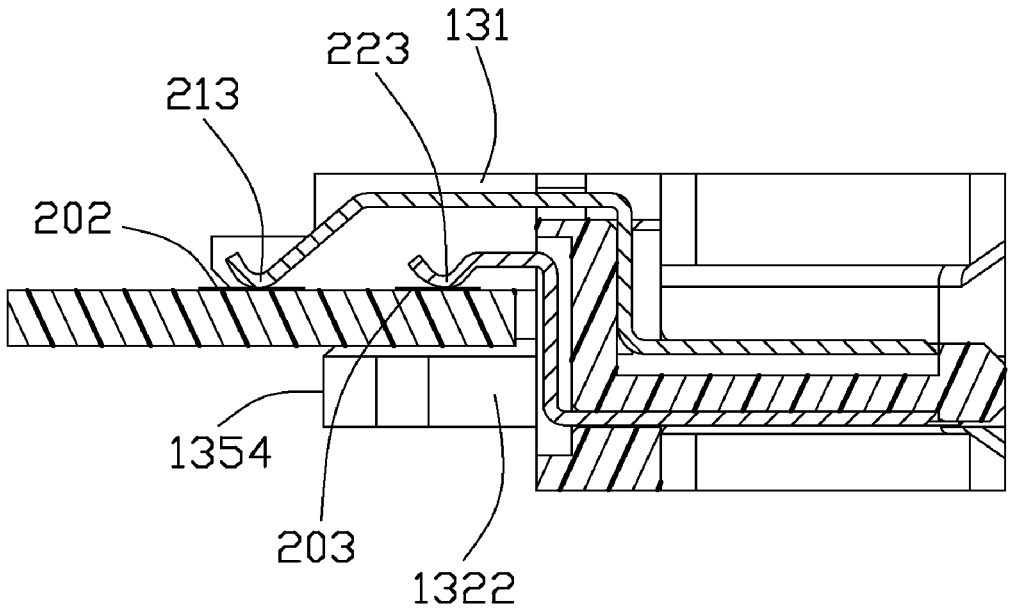
FIG. 5 is a cross-sectional view of the electrical connector assembly taken along lines 5-5 in FIG. 1.
Figure 6:
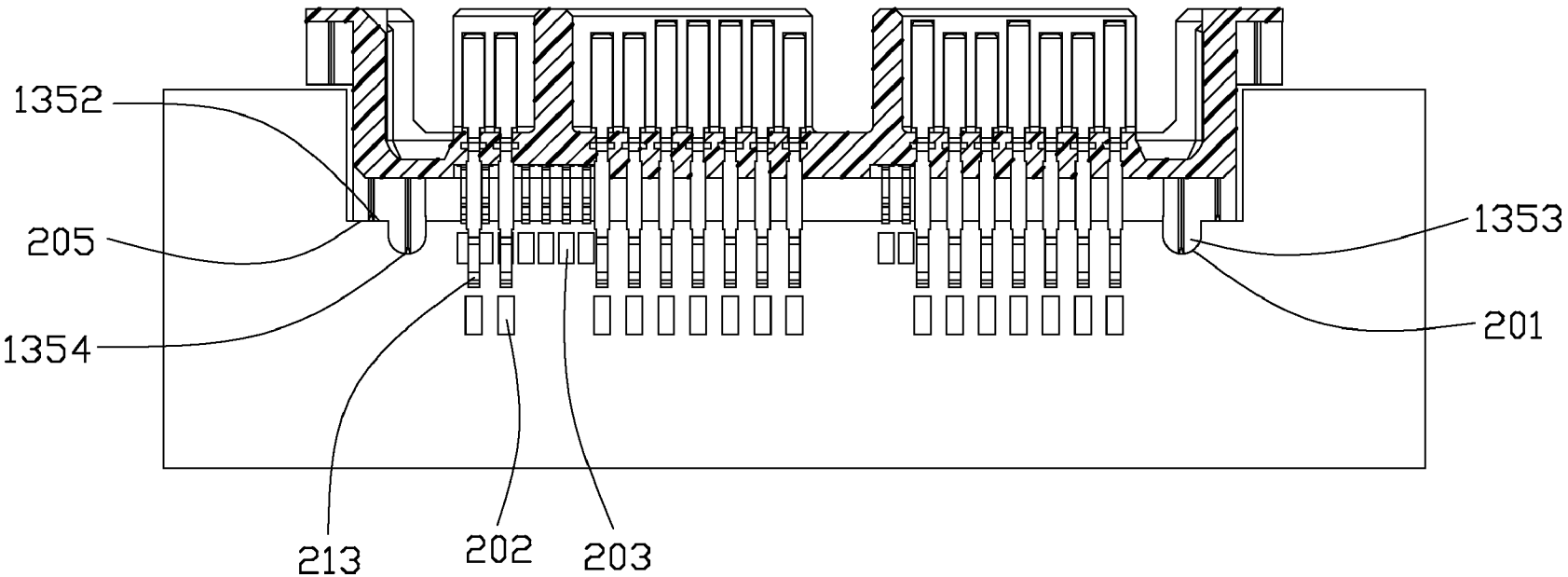
FIG. 6 is a cross-sectional view of the electrical connector assembly taken along lines 6-6 in FIG. 1.

Referring to FIGS. 4 to 6, each of the pair of the clip portions 13 includes a first and a second partition 131,132 parallel to the tongue portions 11. The first partition 131 is located at a side of a bottom face of the tongue portion 11 and the second partition 132 is located at an opposite side of the bottom face. The first and second partitions are separated from each other to define a board-receiving groove 133. The first partition 131 is an entire piece extending from the end face 121 and the back face 102. The second partition 132 includes a lateral portion 1321 extending laterally from the end face 121 of the end wall 12 and a rear portion 1322 extending from the back face 102 of the base 10, but said two portions are separated from each other. The lateral portion 1321 and the first partition 131 are connected with each other by a front partition 134 at a front face thereof and defined a first slit 1331 for retaining a front end of the printed circuit board 200. The rear portion 1322 and the first partition 131 define a second slit 1332 for retaining a rear portion of the printed circuit board 200 therebetween. The first partition 131 is longer than the rear portion 1322 in the clip portion 13 extending direction. The rear portion 1322 is a L-shaped and includes a body portion 1351 defining a rearer face 1352 parallel to the back face 102, a guiding portion 1353 extending rearwardly from the rearer face 1352 and a rearer-most end 1354 defined at the guiding portion 1353 and opposite to the back face 102. The rearer-most end 1354 is the farthest portion away from the back face 102 of the base 10 (refer to FIG. 6). The guiding portion 1353 can accelerate the electrical connector 100 assembled on the printed circuit board 200.

The printed circuit board 200 has a row of first circuit traces 202 for connecting with the first soldering point soldering portion 213 by soldering and a row of second circuit traces 203 for connecting with the second soldering point 223 by soldering. The first circuit traces and the second circuit traces are at the same face of the printed circuit board 200. The printed circuit board 200 has an larger notch 204 provided to seat the housing and two smaller notches 201 at an inner face 205 thereof adjacent to the end faces 121 for matching the guiding portion 1353.

Firstly, the first and second contacts respectively are assembled in the first and second terminal passageways. The first and second contacts are between the pair of the clip portions 13. The rearer-most ends 1354 of the rear portion 1322 are between the first soldering point 213 and the second soldering point 223 from the bottom view (refer to FIGS. 5 and 6). Secondly, the electrical connector 100 is located vertically on the printed circuit board 200. When the printed circuit board 200 is located in the entrance of the second slit 1332, the rearer face 1352 of the rear portion 1322 and the inner face 205 of the printed circuit board 200 are overlapped from the bottom view (refer to FIG. 6). And the first soldering points 213 are located between the first circuit traces 202 and the second circuit traces 203 at the same time. Finally, the printed circuit board 200 moves horizontally toward the electrical connector 100. The printed circuit board 200 enters into the second slit 1332 and the first slit 1331 in turn. The larger notch 204 surrounds the back face 102 and the end faces 121. The electrical connector 100 is secured on the printed circuit board 200 by the way. The first soldering points 213 will not abrade the second circuit traces in the process of assembling, and it ensures a reliable electrical connection. It is also noted that optionally the clip portions 13 may be equipped with embossments and the printed circuit board 200 may be equipped with through holes respectively receiving the embossment once assembled, so as to provide retention between the printed circuit board 200 and the connector 100 in the front-to-back direction.

What is claimed is:

1. An electrical connector assembly, comprising:

a printed circuit board having a row of first circuit traces and a row of second circuit traces on a face thereof adjacent to a notch defined in the PCB;

an electrical connector seated in the notch of the printed circuit board, comprising:

an insulative housing having a longitudinal base defining a mating face and a back face opposite to the mating face and a pair of clip portions extending rearwardly from the back face, each clip portion having a first partition, a second partition and a board-receiving groove therebetween;

a plurality of contacts respectively received in the insulative housing grouped into a set of first and second contacts, the first contacts having first soldering point jointing on the first circuit traces and the second contacts having second soldering points jointing on the second circuit traces;

at least one of the first contacts crossing over the second contacts, and the first soldering point locating at the back of the second soldering point;

wherein the printed circuit board is located in the entrance of the board-receiving groove, the first soldering points are located between the first circuit traces and the second circuit traces; wherein said first partition is longer than the second partition in the clip portions extending direction, the second partition has a rearer face opposite to the back face, the notch of the printed circuit board has an inner face, when the printed circuit board is located in the entrance of the slit, the rearer face and the inner face are overlapped from the bottom view; wherein said second partition has a guiding portion extending rearwardly from the rearer face, the notch has a plurality of smaller notches extending rearwardly from the inner face, the guiding portion matches the smaller notch.

2. The electrical connector assembly as claimed in claim 1, wherein said insulative housing has a tongue portion extending forwardly from the base and a pair of end walls extending forwardly from the base at two sides of the tongue portion, each end wall defines an inverted U-shaped guiding space for guiding an insertion of a complementary connector.

3. The electrical connector assembly as claimed in claim 2, wherein said second partition includes a lateral portion extending laterally from the end wall and a rear portion extending from the back face, but said two portions are separated from each other.

4. The electrical connector assembly as claimed in claim 3, wherein said each first contact has a first retention portion vertical to the tongue portion and the mating face of the base defines a plurality of first retaining slots retaining the first retention portions.

5. The electrical connector assembly as claimed in claim 4, wherein said each second contact has a second retention portion parallel to the tongue portion and a connecting portion connecting with the second retention portion and the second soldering point, the connecting portion has a vertical portion and a horizontal portion, the back face of the base defines a recess receiving the vertical portions.

6. An electrical connector, comprising:

an insulative housing having a longitudinal base defining a mating face and a back face opposite to the mating face and a pair of clip portions extending rearwardly from the back face, each clip portion having a first partition, a second partition and a board-receiving groove extending rearwards therebetween;

a plurality of contacts respectively received in the insulative housing grouped into a set of first and second contacts, each first contact having a first soldering point extending rearwardly and each second contact having a second soldering point extending rearwardly, the first soldering point and the second soldering point being at the same face, at least one of the first contacts crossing over the second contacts, and the first soldering point locating at the back of the second soldering point;

the first partition being longer than the second partition in the clip portion extending direction, each second partition having a rearer-most end opposite to the back face;

wherein the rear portions are between the first soldering points and the second soldering points from the bottom view; wherein said second partition includes a lateral portion extending laterally from the end wall and a rear portion extending from the back face, but said two portions are separated from each other; wherein said rear portion is a L-shaped and includes a body portion and a guiding portion extending rearwardly from the body portion, the rearer-most end is the farthest portion away from the back face of the base; wherein said housing has a tongue portion extending forwardly from the base and a pair of end walls extending forwardly from the base at the two sides of the tongue portion.

7. The electrical connector as claimed in claim 6, wherein said housing defines a plurality of first terminal passageways extending downwardly at one side of the tongue portion and a plurality of second terminal passageways extending upwardly at the other side of the tongue portion, the first and second contacts are respectively secured in the first and second passageways.

8. An electrical connector assembly for being received within a notch of a printed circuit board having thereon opposite first and second surfaces with front and rear rows of traces on the first surface, comprising:

an insulative housing having a main body extending along a longitudinal direction and defining opposite mating port and mounting port in a front-to-back direction perpendicular to said longitudinal direction;

a pair of clip portions located at two opposite ends of the main body in said longitudinal direction, each of said clip portions defining clamping sections located on both lateral side and back side of the main body, and each of said clamping sections including a first part and a second part spaced from each other in a vertical direction perpendicular to both said longitudinal direction and said front-to-back direction, wherein the clamping sections is configure to have the first part intimately confront the first surface of the printed circuit board when assembled; and a plurality of contacts disposed in the housing and arranged in two rows along said longitudinal direction, each of the contacts defining a front mating section exposed in the mating port for mating with a complementary connector, and a rear mounting section exposed in the mounting for mounting to the printed circuit board, wherein the mounting sections of the contacts arranged in front and rear arrays are adapted to abut against the corresponding traces of the front and rear rows for electrical connection therebetween, and the mounting sections of some of said contacts in the front array are at least partially overlapped with those of some of the contacts in the rear array in the front-to-back direction; wherein the rearward boundary of the second part of each clamping section is configuration and dimension to allow a front boundary of the printed circuit board to approach in the vertical direction toward the first part in an intimate confrontation during initial assembling under condition that mounting points of the mounting section of said some of the contacts in the rear array are located between the front row of traces and the rear row of traces which are arranged to respectively contact the mounting sections of said some of the contacts in the front array and those of said some contact in the rear array; whereby the printed circuit board is allowed to successively move forward to have a circumferential region around the notch fully retained in the corresponding clamping sections, and the mounting sections of the contacts in the rear array mechanically and electrically contact the traces of the rear row and those of the contacts in the front array mechanically and electrically contact the traces of the front row.

9. The electrical connector as claimed in claim 8, wherein the first part extends rearwardly beyond the second part for providing more supporting area for abutting against the first surface of the printed circuit board.

10. The electrical connector as claimed in claim 8, wherein a pitch of the mounting sections of the contact in the front array is different from that of the mounting sections of the contacts in the second array.

11. The electrical connector as claimed in claim 8, wherein the second part of the clamping section includes a rearwardly extending guiding portion for alignment within and passing through a corresponding smaller notch, which is located in the circumferential region of the printed circuit board, during initial assembling between the printed circuit board and the connector in the vertical direction.

12. The electrical connector as claimed in claim 8, wherein the clip portions defines a board-receiving groove therebetween in the vertical direction, which is located at a level different from a mating tongue defined in the mating port under condition that the mating sections of the contacts are locate at two opposite faces of said mating tongue.

13. The electrical connector as claimed in claim 12, wherein the mounting sections of the contacts are essentially located at another level under condition that the level defined by the board-receiving groove is located between the level defined by the mating tongue and the level defined by the mounting sections of the contacts.

14. The electrical connector as claimed in claim 8, wherein the housing is equipped with a mating tongue in the mating port with mating sections of the contacts in two rows respectively exposed on two opposite faces thereof under condition that the housing is configured to allow the contacts with the mounting sections in the front array to be assembled forwardly thereto in the front-to-back direction while the contacts with the mounting sections in the rear array to be assembled inwardly in the vertical direction.

15. The electrical connector as claimed in claim 14, wherein the mating sections of the contacts having the mounting sections in the rear array are located closer to the printed circuit board, in the vertical direction, than those of the contacts having the mounting sections in the front array.

* * * * *